United States Patent [19]

Davey et al.

[11] 4,389,295

[45] Jun. 21, 1983

[54] THIN FILM PHOSPHOR SPUTTERING PROCESS

[75] Inventors: Ernest Davey, Peabody; Lawrence L. Hope, Stow; Charles E. Deschenes, Marblehead, all of Mass.

[73] Assignee: GTE Products Corporation, Stamford, Conn.

[21] Appl. No.: 375,626

[22] Filed: May 6, 1982

[51] Int. Cl.[3] ..... C23C 15/00

[52] U.S. Cl. ..... 204/192 P; 204/192 R; 204/298; 204/157.1 R

[58] Field of Search ..... 204/192 P, 192 R, 298

[56] References Cited

U.S. PATENT DOCUMENTS

| | | | |
|---|---|---|---|
| 3,515,663 | 6/1970 | Bodway | 204/298 |
| 3,775,285 | 11/1973 | Lane | 204/298 |
| 3,787,312 | 1/1974 | Wagner et al. | 204/298 |
| 3,793,167 | 2/1974 | Glaser | 204/298 |
| 3,884,787 | 5/1975 | Kuehnle | 204/298 |
| 4,248,687 | 2/1981 | Fan | 204/192 P |

*Primary Examiner*—Arthur P. Demers

*Attorney, Agent, or Firm*—William H. McNeill

[57] ABSTRACT

A process and associated system for forming a thin film phosphor layer which is comprised of a host substance doped with an activator and which layer is formed by a sputtering process. Heat is applied to the substrate to elevate the temperature thereof while maintaining a vacuum in the sputtering chamber. The substrate is supported for movement in the chamber. Sputtering is accomplished within the chamber by causing a sputtering gas to flow therein while concurrently exciting host and activator targets to form a plasma in the chamber and maintaining this sputtering for a predetermined period of time.

24 Claims, 1 Drawing Figure

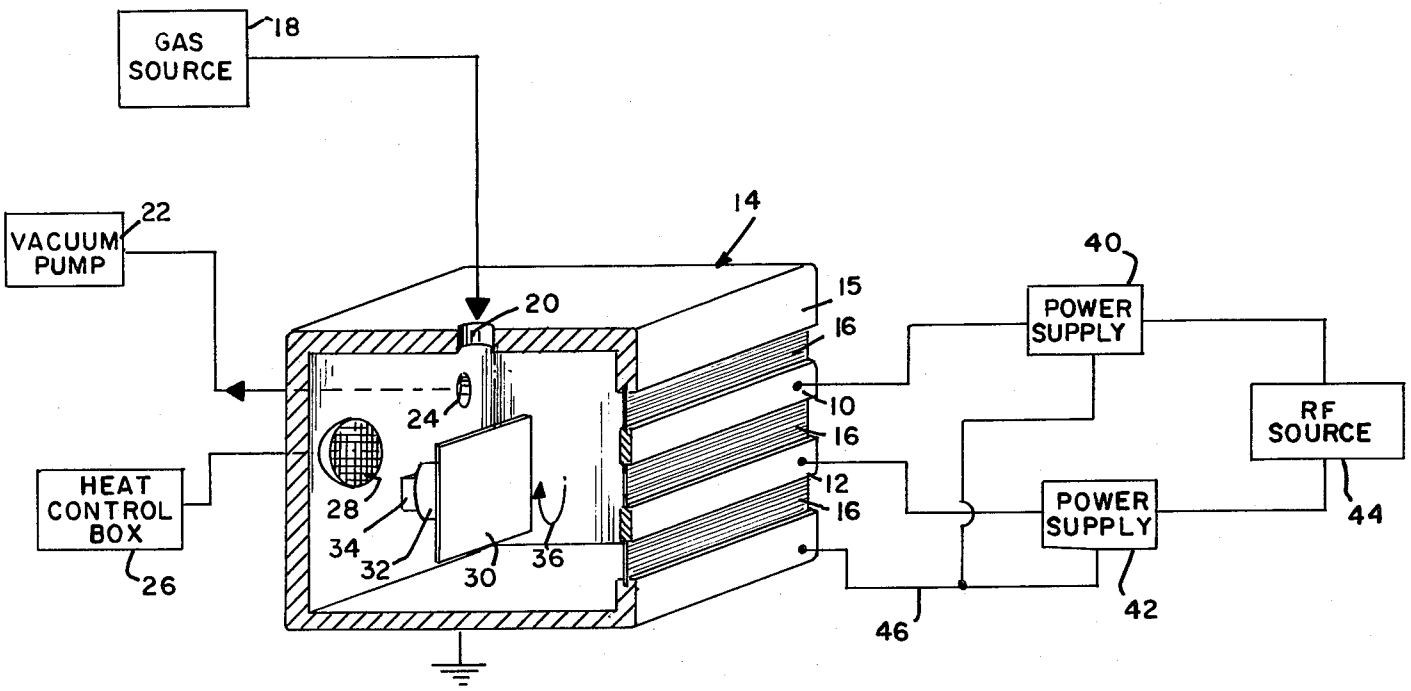
RF SOURCE
44
POWER SUPPLY
40
POWER SUPPLY
42
46
15
16
10
16
12
16
14
20
36
30
24
32
34
28
18
GAS SOURCE
22
VACUUM PUMP
HEAT CONTROL BOX
26

THIN FILM PHOSPHOR SPUTTERING PROCESS

TECHNICAL FIELD

The present invention relates to a sputtering process and associated system used in making thin film phosphors for displays and, more particularly, to a controlled sputtering process and associated system usable in the making of thin film phosphor layers for electroluminescent displays and adapted to high volume, low cost, high yield process operation.

BACKGROUND OF THE INVENTION

A thin film electroluminescent display device typically comprises several thin film layers and is adapted to emit visible light upon the imposition of a voltage across the electrodes of the device. The electrodes typically include front and rear patterned electrodes. The active, light emitting element of the device is a thin film phosphor layer which, by the principle of electroluminescence, is excited to emit light in an electric field. In addition to the phosphor layer there are the aforementioned electrodes, one or more dielectric layers for electrical isolation and, if desired, a dark field for contrast enhancement. In addition, there is commonly provided a substrate upon which the layers are formed and some type of means for encapsulating and sealing the device.

The phosphor layer generally comprises a host substance doped with an activator. A host substance that is commonly used is zinc sulfide. The dopant or activator is manganese. Such a phosphor layer emits in the yellow portion of the spectrum at about 590 nm, and has excellent color stability. Another common host substance is zinc selenide.

To provide a properly operating device the phosphor layer must be free from impurities and, moreover, must be uniform as to composition, thickness and doping level. Furthermore, it is essential that the correct stoichiometry and crystal structure be maintained and that the dopant atoms enter the crystal lattice as substitutes for zinc atoms, rather than interstitially.

In presently used processes the zinc sulfide and manganese are co-deposited employing thermal and electron beam deposition techniques. One technique employs a single pumpdown system for thermal evaporation of zinc sulfide along with simultaneous electron beam evaporation of manganese metal. In such co-evaporation systems, rate control is difficult, especially with respect to the dopant, as the rate monitor is generally swamped by the disproportionate high percentage, of about 99%, of zinc sulfide. Furthermore, uniformity over a large area, required for high volume production, is virtually impossible because the evaporation sources are small in comparison with the substrate area. Reproducibility is also a notorious problem with these co-evaporation systems.

DISCLOSURE OF THE INVENTION

Accordingly, it is an object of the present invention to provide an improved process for producing thin film phosphors for a display device and in which the phosphor layer is deposited under close rate control.

Another object of the present invention is to provide an improved process employing sputtering for producing a thin film phosphor layer for a display in which the phosphor layer is formed uniformly. Uniformity is achieved in accordance with the present invention by the selection of a sputtering source (target) large in comparison with the substrate upon which the phosphor is being deposited.

A further object of the present invention is to provide an improved process preferably employing sputtering for producing thin film phosphor layers for display devices and in which the phosphor layer is deposited with good reproducibility from substrate to substrate.

Still another object of the present invention is to provide a sputtering process for making thin film phosphor layers for displays in which the phosphor layer is substantially free from impurities and, furthermore, is uniform as to its composition, thickness and doping level.

Still a further object of the present invention is to provide an improved process for making bright, stable, thin film phosphor layers for displays producible at high volume, at lost cost, and with a high yield.

It is yet another object of the invention to obviate the disadvantages of the prior art.

Still another object of the present invention is to provide an improved sputtering process for use in producing thin film phosphor layers for electroluminescent displays in which the rate is closely controlled such as with the use of a power setting thereby eliminating the need for such devices as rate monitors and feedback control loops.

To accomplish the foregoing and other objects of this invention, there is provided in accordance with one aspect of the invention a process for forming a thin film phosphor layer, which layer is comprised of a host substance doped with an activator. The phosphor layer is formed on a substrate in the making of an electroluminescent display device. The steps of the process comprise: providing a phosphor chamber having targets of respective host substance and activator, applying heat to the substrate to elevate the temperature thereof while maintaining a vacuum in the chamber, and supporting and rotating the substrate in the chamber, said rotation being for the purpose of assuring uniformity of exposure of the substrate to the target. Translational motion for assuring uniformity may be used instead of or in conjunction with rotational motion. This motion may carry the substrate past the targets in multiple passes back and forth. The process of the present invention employs sputtering by causing a sputtering gas to flow into the chamber while concurrently exciting the targets so as to form a plasma in the chamber. Finally, the sputtering is maintained for a period of time.

In accordance with more particular features of the invention, a carrier is provided for the substrate and causes rotation of the substrate at a predetermined speed of rotation such as at 30 RPM, or translational motion at a speed such as 0.5 inch per second. The sputtering gas may comprise an inert gas mixed with a small percentage of hydrogen sulfide, such as on the order of 1.5% to 10% hydrogen sulfide. The targets may be of, respectively, zinc sulfide and manganese. The sputtering gas flow to the chamber is preferably at a predetermined rate, such as on the order of 130 sccm. The sputtering time period is preferably on the order of 30 minutes, and for this time period the phosphor layer provides a 190 fl phosphor at 200 Hertz. In accordance with the process of this invention it is also preferred to sputter a dielectric layer prior to the phosphor layer. This dielectric layer may typically be of yttrium oxide. The heat that is applied in the process may be at a temperature on the order of 300° C. In accordance with another aspect of the present invention the targets, which may be of zinc sulfide and manganese, are commonly excited from an RF energy source.

In accordance with another aspect of the present invention there is provided a system for forming a thin film phosphor layer which is comprised of a host substance doped with an activator. The phosphor layer is formed on a substrate in the making of an electroluminescent display. The system comprises a phosphor chamber, targets associated with the chamber and of respective host substance and activator, means for maintaining a vacuum in the chamber and a heat source associated with the chamber for heating the substrate. A carrier is preferably provided for holding the substrate and means are provided for rotating or translating the carrier to assure uniformity of exposure of the substrate to the targets. Means are provided for introducing a sputtering gas into the chamber to produce sputtering and concurrently means are provided for exciting the targets. In this regard, the system includes separate target power supplies both commonly excited from an RF energy source with the target power supplies being controlled at different wattages. In accordance with one specific example, the RF power is at 750 watts with regard to the zinc sulfide target and at 100 watts with regard to the manganese target.

BRIEF DESCRIPTION OF THE DRAWING

The single FIGURE is a diagrammatic representation of a sputtering system employed with the present invention.

BEST MODE FOR CARRYING OUT THE INVENTION

For a better understanding of the present invention, together with other and further objects, advantages, and capabilities thereof, reference is made to the following disclosure and appended claims taken in conjunction with the above-described drawing.

Referring now to the drawing with greater particularity, there is shown a system employable in practicing the process of the invention.

In particular, a sputtering process is employed for producing a bright, stable, thin film phosphor layer which forms part of a display device. The sputtering technique is particularly advantageous in that the rate of deposition can be closely controlled simply by power settings and thus not requiring such devices as rate monitors or the use of feedback control loops. Also, uniformity of the deposition can be achieved primarily because the sputtering sources (targets) are large in comparison with the substrate. Also, reproducibility is greatly increased over the prior art processes.

The sputtering technique described herein is compatible with inline equipment in which successive layers are deposited in successive chambers without venting between depositions. This eliminates problems with humidity and impurities which are unavoidable when a vacuum system is vented.

With the process and associated system of this invention devices are produced that emit 190 footlamberts (fl) at 200 Hertz. Co-sputtering is employed with two targets, one of which may be a zinc sulfide target and the other a target of manganese metal. The drawing illustrates the zinc sulfide target 10 and the manganese target 12 both of which are associated with and form part of the sputtering chamber 14. Both of the targets 10 and 12 are of the type that are readily available commercially. These targets are supported in the chamber wall 15 with the use of spacers 16 which are constructed of an electrically insulating material such as, for example, teflon. At least the zinc sulfide target 10 is preferably bonded to a water cooled backing plate not illustrated in the drawing. The targets, backing plates, water cooling apparatus, and ground shields for RF control are incorporated in a cathode assembly (not illustrated). Separate cathode assemblies for each target may also be used. The cathodes provide RF and vacuum isolation.

The system also includes a sputtering gas source 18 coupled to the input port 20 of the chamber 14. A vacuum pump 22 is also preferably employed coupled to another port 24 of the chamber. In accordance with the process to be described hereinafter, there is also provided a heat control box 26 which couples to the heating lamp 28. One or more lamps may actually be employed in connection with the chamber.

The drawing also illustrates the substrate 30 suitably disposed in the chamber and facing the targets 10 and 12. This may be a glass substrate to which has been previously deposited, by sputtering, a dielectric layer such as one of ytterium oxide. The substrate 30 is schematically illustrated as being supported by a carrier 32 which in turn is driven by a motor means 34 so that the substrate may be rotated in the direction of the arrow 36. The carrier 32 may be rotated at a rate of 30 RPM. Translating may be used with or in place of rotation. The gas source 18 introduces the sputtering gas into the chamber while the vacuum pump 22 maintains a proper vacuum within the chamber to maintain proper cleanliness. A CTI Cryo-Torr 8 pump or other high vacuum pumps may be employed.

The targets 10 and 12 are excited by the arrangement schematically illustrated in the drawing including power supplies 40 and 42 and the RF source 44. Power supply 40 is associated with target 10 and power supply 42 with target 12. There is also provided a common line 46 from both of the power supplies to the housing which is considered as being at ground potential. The RF energy from the source 44 is coupled by way of the supplies 40 and 42 to the targets 10 and 12 respectively. The power supplies 40 and 42 along with the source 44 may be plasma-therm equipment with a 3 KW capability with regard to the zinc sulfide target and a 500 watt capability as far as the manganese target is concerned. However, as described hereinafter with regard to the process, the RF power coupled to the zinc sulfide target is preferably on the order of 750 watts and that coupled to the manganese target is preferably on the order of 100 watts. It is noted that a single RF source 44 feeds both targets. This is a form of co-excitation. This is used to prevent beats and plasma instability. This assures a certain uniformity of excitation of the targets.

The sputtering gas from the gas source 18 may be composed of argon pre-mixed with a small percentage of hydrogen sulfide such as 1.5% to 10% hydrogen sulfide. The flow rate may be 130 sccm (standard cubic centimeters per minute). The sputtering pressure is preferably maintained on the order of 6 microns. Hydrogen sulfide is used in the sputtering gas to restore sulphur stoichiometry, which would otherwise be deficient as the manganese target supplies no sulphur. A Vacuum General product 77-1 is typically used as a flow controller to maintain gas flow and sputtering pressure.

In accordance with the process the substrate, such as the substrate 30 illustrated in the drawing, is usually provided initially with a dielectric layer such as one of yttrium oxide which may be deposited by a sputtering technique. This occurs in a separate chamber. Without any venting of the drawn vacuum, the substrate with its carrier is then moved into the phosphor chamber 14. In the event that a mask changing facility is installed a new mask may be engaged. The one or more heat lamps 28 that are employed are operated so as to maintain the substrate at about 300° C. During the process the carrier 32 for holding the substrate is rotated at a fixed speed, such as at 30 RPM, or translated at a fixed speed back and forth past the targets. In the process, the sputtering gas flows via the port 20 to the sputtering chamber at a pressure of, say, 130 sccm. The gas, as mentioned previously, may be pure argon pre-mixed with a small percentage of hydrogen sulfide. The sputtering pressure is maintained by the aforementioned controller at, say, 6 microns. The RF source 44 is excited concurrently with introduction of the sputtering gas so that the zinc sulfide target is excited at 750 watts while the manganese target is excited at 100 watts. Again, a co-exciter arrangement is used so that both power supplies 40 and 42 are from the same RF source. This enhances uniformity of deposition and prevents process instabilities.

The application of the RF energy to the targets is controlled along with the introduction of the sputtering gas so as to provide sputtering for a suitable period of time. A sputtering interval of 30 minutes producing a 190 fl phosphor at 200 Hertz. If a shorter sputtering period is employed there will be a reduction in brightness and operating voltage. Next, if a mask changing facility is installed, the mask may be removed. The chamber is not to be vented but the vacuum is to be maintained, and then the substrate moved to another chamber under vacuum for deposition of the next layer.

Having described a limited number of embodiments of the invention, it should now be apparent to those skilled in the art that numerous other embodiments are contemplated as falling within the scope of this invention. For example, although the process and system have been described in connection with forming a phosphor of zinc sulphide and manganese, the process may also be employed using other host substances, such as zinc selenide. Moreover, the doping may be by other rare earth elements, such as terbium or europium fluoride. Also, copper is a possible dopant. The system may even employ more than two targets in which case all three targets or more would be excited commonly.

What is claimed is:

1. A process for forming a thin film phosphor layer comprised of a heat substance doped with an activator, said phosphor layer being formed on a substrate in the making of an electroluminescent display device, comprising the steps of:

providing a phosphor chamber having targets of respective host substance and activator, applying heat to said substrate to elevate the temperature thereof while maintaining a vacuum in the chamber, supporting and rotating or translating the substrate in the chamber, initiating sputtering within the chamber by causing a sputtering gas to flow therein while concurrently exciting said targets to form a plasma in said chamber, and maintaining the sputtering for a period of time.

2. A process as set forth in claim 1 including providing a carrier for the substrate and rotating the carrier at a predetermined speed of rotation.

3. A process as set forth in claim 1 including providing a carrier for the substrate and moving the carrier translationally at a predetermined speed.

4. A process as set forth in claim 1 wherein said sputtering gas comprises an inert gas pre-mixed with a small percentage of hydrogen sulfide.

5. A process as set forth in claim 4 wherein said small percentage is on the order of 1.5% to 10%.

6. A process as set forth in claim 1 wherein said targets are respectively of zinc sulfide and manganese.

7. A process as set forth in claim 1 wherein the gas flow is at a predetermined rate.

8. A process as set forth in claim 7 wherein said rate is on the order of 130 sccm.

9. A process as set forth in claim 1 wherein the sputtering time period is on the order of thirty minutes.

10. A process as set forth in claim 1 including sputtering a dielectric layer prior to the phosphor layer.

11. A process as set forth in claim 1 including rotating the substrate at a rate on the order of 30 RPM.

12. A process as set forth in claim 1 including translational motion at a rate on the order of 0.5 inch per second past the target in single or multiple passes.

13. A process as set forth in claim 1 wherein heat is applied at a temperature on the order of 300° C.

14. A process as set forth in claim 1 wherein said targets are commonly excited by RF energy.

15. A process as set forth in claim 1 wherein electrical bias is applied to the substrate.

16. A system for forming a thin film phosphor layer comprised of a host substance doped with an activator, said phosphor layer being formed on a substrate in the making of an electroluminescent display device, comprising:

a phosphor chamber;

targets associated with the chamber and of respective host substance and activator;

means maintaining a vacuum in the chamber;

a heat source associated with the chamber for heating the substrate;

a carrier for the substrate;

means for rotating or translating the carrier to assure uniformity of exposure of the substrate to the targets;

means for introducing a sputtering gas into the chamber to produce sputtering; and means for exciting said targets.

17. A system as set forth in claim 16 wherein said sputtering gas comprises an inert gas pre-mixed with a small percentage of hydrogen sulfide.

18. A system as set forth in claim 17 wherein said inert gas includes argon and said small percentage is on the order of 1.5% to 10%.

19. A system as set forth in claim 16 wherein said targets are respectively of zinc sulfide and manganese.

20. A system as set forth in claim 16 wherein the gas flow is at a predetermined rate.

21. A system as set forth in claim 20 wherein said rate is on the order of 130 sccm.

22. A system as set forth in claim 16 wherein the sputtering time period is on the order of 30 minutes.

23. A system as set forth in claim 16 wherein said means for rotating rotates the substrate at a rate on the order of 30 RPM.

24. A system as set forth in claim 16 wherein said means for translating the substrate provides motion past the target at a rate on the order of 0.5 inch per second in single or multiple passes.

* * * * *